US005779561A

United States Patent [19]

Sullivan et al.

[11] Patent Number: 5,779,561

[45] Date of Patent: Jul. 14, 1998

[54] GOLF BALL AND METHOD OF MAKING SAME

[76] Inventors: Michael J. Sullivan, 58 Marlborough St., Chicopee, Mass. 01020; R. Dennis Nesbitt, 70 Deer Path La., Westfield, Mass. 01085; Mark L. Binette, 241 Elizabeth Dr., Ludlow, Mass. 01056

[21] Appl. No.: 762,947

[22] Filed: Dec. 10, 1996

Related U.S. Application Data

[63] Continuation-in-part of Ser. No. 495,062, Jun. 26, 1995.

[51] Int. Cl.[6] ..... A63B 37/06; A63B 37/12

[52] U.S. Cl. ..... 473/373; 473/374; 473/378; 525/221; 273/DIG. 22

[58] Field of Search ..... 473/373, 374, 473/378, 385; 525/221; 273/DIG. 22

[56] References Cited

U.S. PATENT DOCUMENTS 4,431,193 2/1984 Nesbitt ..... 473/374

4,919,434 4/1990 Saito ..... 473/373

5,397,840 3/1995 Sullivan et al. ..... 473/385 X 5,516,847 5/1996 Sullivan et al. ..... 473/385 X

*Primary Examiner*—George J. Marlo

[57] ABSTRACT

Disclosed herein is a multi-layer golf ball having a central core, an inner cover layer containing a non-ionomeric polyolefin material and a filler, and an outer cover layer comprising a resin composition. The combined thickness of the inner and outer cover layer preferably is at least about 0.10 inches. The golf ball has a coefficient of restitution of at least about 0.750. When the inner cover layer contains a non-ionomeric material and the outer cover layer contains, e.g., an ionomer, the golf ball of the invention can be configured to have playability properties comparable to those of golf balls which contain substantially higher quantities of ionomer. A method for forming the golf ball described above also is disclosed.

35 Claims, 1 Drawing Sheet

GOLF BALL AND METHOD OF MAKING SAME

RELATED APPLICATIONS

This is a continuation-in-part of U.S. patent application Ser. No. 08/495,062 filed Jun. 26, 1995.

FIELD OF THE INVENTION

The present invention generally relates to golf balls, and more particularly to a golf ball having a multi-layer cover.

BACKGROUND OF THE INVENTION

Golf balls traditionally have been categorized in three different groups, namely as one-piece balls, multi-piece (two or more piece) solid balls and wound balls. Conventional multi-piece solid golf balls include a uniform or multi-layer solid resilient core having a cover of a different type of material molded thereon. Wound golf balls traditionally have included a liquid or solid center, elastomeric winding around the center, and a molded cover. Solid cores often are made of polybutadiene and the molded covers generally are made of natural balata, synthetic balata, ionomeric resins, crosslinked polyurethane, or thermoplastic polyurethane.

Ionomeric resins are polymers containing interchain ionic bonding. As a result of their toughness, durability and flight characteristics, various ionomeric resins sold by E. I. DuPont de Nemours & Company under the trademark "Surlyn®" and by the Exxon Corporation (see U.S. Pat. No. 4,911,451) under the trademarks "Escor®" and the trade name "Iotek", have become the materials of choice for the construction of golf ball covers over the traditional "balata" (transpolyisoprene, natural or synthetic) rubbers. The softer balata covers, although exhibiting enhanced playability properties, lack the durability (cut and abrasion resistance, fatigue endurance, etc.) properties required for repetitive play.

Ionomeric resins are generally ionic copolymers of an olefin, such as ethylene, and a metal salt of an unsaturated carboxylic acid, such as acrylic acid, methacrylic acid or maleic acid. Metal ions, such as sodium or zinc, are used to neutralize some portion of the acidic group in the copolymer resulting in a thermoplastic elastomer exhibiting enhanced properties, i.e., durability, etc., for golf ball cover construction over balata.

While there are currently more than fifty (50) commercial grades of ionomers available both from Exxon and DuPont, with a wide range of properties which vary according to the type and amount of metal cations, molecular weight, composition of the base resin (i.e., relative content of ethylene and methacrylic and/or acrylic acid groups) and additive ingredients such as reinforcement agents, etc., a great deal of research continues in order to develop golf ball covers exhibiting the desired combination of the properties of carrying distance, durability, and spin.

Various non-ionomeric thermoplastic materials have been used for golf ball covers, but have been found inferior to ionomers in achieving good cut resistance, fatigue resistance and travel distance. It would be useful to obtain a golf ball having a cover which incorporates nonionomeric materials while achieving the favorable playability and durability characteristics of a ball having a cover which primarily contains ionomers.

U.S. Pat. Nos. 4,431,193 and 4,919,434 disclose multi-layer golf balls. U.S. Pat. No. 4,431,193 discloses a multi-layer ball with a hard ionomeric inner cover layer and a soft outer cover layer. U.S. Pat. No. 4,919,434 disclose a golf ball with a 0.4–2.2 mm thick cover made from two thermoplastic cover layers.

Golf balls are typically described in terms of their size, weight, composition, dimple pattern, compression, hardness, durability, spin rate and coefficient of restitution (COR). One way to measure the COR is to propel a ball at a given speed against a hard massive surface, and to measure its incoming and outgoing velocity. The COR is the ratio of the outgoing velocity to the incoming velocity and is expressed as a decimal between zero and one.

There is no United States Golf Association limit on the COR of a golf ball but the initial velocity of the golf ball must not exceed 250±5 ft/second. As a result, the industry goal for initial velocity is 255 ft/second, and the industry strives to maximize the COR without violating this limit.

SUMMARY OF THE INVENTION

An object of the invention is to provide a golf ball having a good coefficient of restitution while reducing the overall quantity of ionomer in the cover.

Another object of the invention is to provide a golf ball having a good carrying distance while maintaining a relatively soft compression.

Another object of the invention is to provide an oversized golf ball having a favorable combination of a soft compression and a good COR.

Yet another object of the invention is to provide a multi-layer solid golf ball having durability and playability properties which are comparable to those of a golf ball having a single ionomeric cover layer.

Another object of the invention is to provide a multi-layer golf ball with a non-ionomeric mantle layer and which exhibits good playability properties.

A further object of the invention is to provide a method of making a golf ball having the features described above.

Other objects will be in part obvious and in part pointed out more in detail hereinafter.

The invention in a preferred form is a golf ball comprising a core, an inner cover layer comprising (1) a first resin composition containing at least 50 parts by weight of a non-ionomeric polyolefin material and (2) at least one part by weight of a filler, the parts by weight of non-ionomeric polyolefin material and filler being based upon 100 parts by weight of the first resin composition, and an outer cover layer comprising a second resin composition which is different from the first resin composition. The overall cover thickness is at least about 0.10 inches, and preferably is at least 0.13 inches. The golf ball preferably has a coefficient of restitution of at least about 0.750.

The inner cover layer preferably has a flexural modulus of about 1,000–100,000 p.s.i., more preferably 1,500–75,000 p.s.i., and most preferably 2,000–50,000 p.s.i. The inner cover layer preferably has a polymer density of about 0.7–1.5 g/cc, more preferably 0.75–1.3 g/cc and most preferably 0.8–1.2 g/cc. In a particularly preferred form of the invention, the resin composition of the inner cover layer contains at least 75 parts by weight, and most preferably at least 90 parts by weight of a non-ionomeric polyolefin material. The inner cover layer preferably has a Shore D hardness of less than 65 (measured generally in accordance with ASTM D-2240, but measured on the curved surface of the inner cover layer) and a thickness of at least 0.040 inches. The outer cover layer preferably has a greater hardness than the inner cover layer and a Shore D hardness of at least 60 (measured generally in accordance with ASTM D-2240, but measured on a land area of the curved surface of the outer cover layer). The outer cover layer preferably has a thickness of at least about 0.030 inches.

Another preferred form of the invention is a golf ball having a core, an inner cover layer comprising (1) a first resin composition which contains at least 50 parts by weight of a non-ionomeric polyolefin material and (2) one or more parts by weight of at least one of a density-adjusting filler and a flex modulus adjusting filler, the parts by weight of non-ionomeric polyolefin material and filler being based upon 100 parts by weight of the first resin composition, and an outer cover layer comprising a second resin composition which is different from the first resin composition. The inner cover layer preferably has a Shore D hardness of less than 65 (measured generally in accordance with ASTM D-2240, but measured on the curved surface of the inner cover layer).

Another preferred form of the invention is a golf ball comprising a core, an inner cover layer comprising (1) a first resin composition containing at least 50 parts by weight of a non-ionomeric polyolefin material and (2) one or more parts by weight of a filler with a specific gravity which is at least 0.05 higher or lower than the specific gravity of the first resin composition, the parts by weight of non-ionomeric polyolefin material and filler being based upon 100 parts by weight of the first resin composition, and an outer cover layer comprising a thermoplastic material.

A further preferred form of the invention is a method of making a golf ball which has a core and has an outer cover layer comprising a second resin composition. The method comprises positioning between the core and outer cover layer an inner cover layer comprising a first resin composition which is different from the second resin composition and which contains at least 50 parts by weight of a non-ionomeric polyolefin material, the inner cover layer further including one or more parts by weight of at least one of a density-adjusting filler and a flex modulus adjusting filler, the parts by weight of non-ionomeric polyolefin material and filler being based upon 100 parts by weight of the first resin composition. The golf ball preferably has a coefficient of restitution of at least 0.750.

Yet another preferred form of the invention is a method of making a golf ball having a core, an outer cover layer comprising a second resin composition, the method comprising positioning an inner cover layer between the core and the outer cover layer, the inner cover being formed from a first resin composition which is different from the second resin composition and which includes at least 50 parts by weight of a non-ionomeric polyolefin material, the inner cover layer further including one or more parts by weight of a filler, the parts by weight of non-ionomeric polyolefin and filler being based upon 100 parts by weight of the first resin composition, the overall cover thickness of the golf ball being at least 0.10 inches.

The invention accordingly comprises the several steps and the relation of one or more of such steps with respect to each of the others and the article possessing the features, properties, and the relation of elements exemplified in the following detailed disclosure.

DETAILED DESCRIPTION OF THE INVENTION

Figure 1:
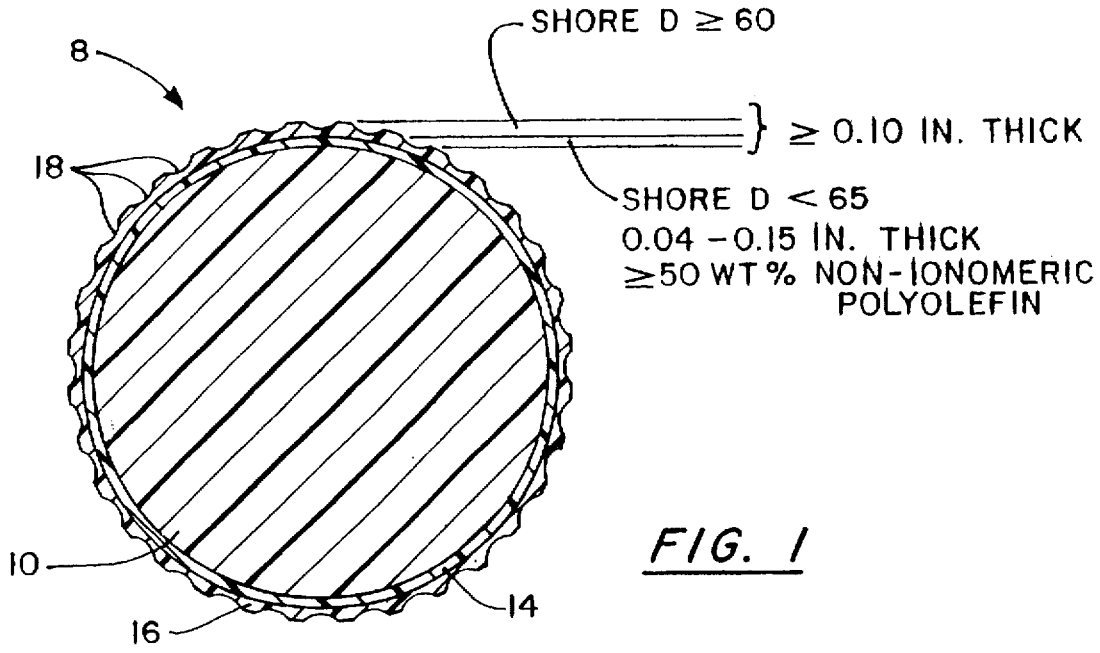
FIG. 1 shows a cross-sectional view of a golf ball according to a preferred embodiment of the invention.
Figure 2:
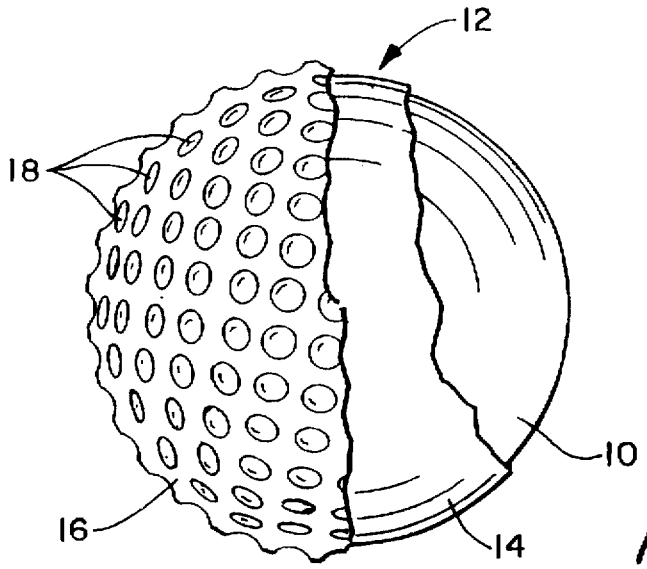
FIG. 2 shows a side elevational view of the golf ball shown in FIG. 1 with the cover layers partially broken away.

The golf ball according to the invention has a central core and a thick cover which includes at least two separate layers. The golf ball is constructed to have a favorable combination of soft PGA compression and a good coefficient of restitution (COR) or resilience.

The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR in solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically.

Speeds were measured with a pair of Oehler Mark 55 ballistic screens available from Oehler Research, Inc., P.O. Box 9135, Austin, Tex. 78766, which provide a timing pulse when an object passes through them. The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specifications regulated by the United States Golf Association (U.S.G.A.). As mentioned to some degree above, the U.S.G.A. standards indicate that a "regulation" ball cannot have an initial velocity exceeding 255 feet per second in an atmosphere of 75° F. when tested on a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc.).

PGA compression is another important property involved in the performance of a golf ball. The compression of the ball can affect the playability of the ball on striking and the sound or "click" produced. Similarly, compression can effect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core thereby resulting in more "grab" of the ball on the clubface and subsequent higher spin rates. In effect the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, PGA compression indicates the amount of change in golf ball's shape upon striking. The development of solid core technology in two-piece balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multilayer solid core balls exhibit much more consistent compression readings than balls having wound cores such as the thread wound three-piece balls.

In the past, PGA compression related to a scale of from 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0. Every change of 0.001 of an inch in deflection represents a 1 point drop in compression. Consequently, a ball which deflects 0.1 inches (100×0.001 inches) has a PGA compression value of 100 (i.e., 200–100) and a ball which deflects 0.110 inches (110×0.001 inches) has a PGA compression of 90 (i.e., 200–110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by Atti Engineering Corporation of Newark, N.J. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring-loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilizes a modified Riehle Compression Machine originally produced by Riehle Bros. Testing Machine Company, Phil., Pa. to evaluate compression of the various components (i.e., cores, mantle cover balls, finished balls, etc.) of the golf balls. The Riehle compression device determines deformation in thousandths of an inch under a fixed initialized load of 200 pounds. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression =160-Riehle compression. Consequently, 80 Riehle compression corresponds to 80 PGA compression,70 Riehle compression corresponds to 90 PGA compression, and 60 Riehle compression corresponds to 100 PGA compression. For reporting purposes, Applicant's compression values are usually measured as Riehle compression and converted to PGA compression.

Furthermore, additional compression devices may also be utilized to monitor golf ball compression so long as the correlation to PGA compression is know. These devices have been designed, such as a Whitney Tester, to correlate or correspond to PGA compression through a set relationship or formula.

Referring now to the Figures, a golf ball according to the invention is shown and is designated as 8. The golf ball includes a central core 10 and a cover 12. The cover 12 includes an inner cover layer 14, which contains a filler, and an outer cover layer 16. Dimples 18 are formed in the outer surface of the outer cover layer 16. The ball preferably has a diameter of at least 1.68 inches, and more preferably at least 1.70 inches.

The core 10 of the golf ball typically is a solid (non-wound) core made of a crosslinked unsaturated elastomer and preferably comprises a thermoset rubber such as polybutadiene, but also can be made of other core materials which result in a golf ball with sufficient COR. For example, the core can be wound, with a liquid or solid center. Furthermore, non-wound liquid or gel-type cores can be used, as well as multi-layer (two or more layer) solid cores including a central core and one or more surrounding shells. The diameter of the core 10 is determined based upon the desired overall ball diameter minus the combined thicknesses of the inner and outer cover layers. The COR of the core 10 is appropriate to impart to the finished golf ball a COR of at least 0.750, preferably at least 0.770, and more preferably at least 0.780. The core 10 typically has a diameter of about 1.0–1.6 inches and preferably 1.4–1.6 inches, a PGA compression of 60–100, and a COR in the range of 0.740–0.820. The Shore D hardness of the outer surface of the core typically is about 25–80 (measured generally in accordance with ASTM D-2240, but measured on the curved surface of the core).

Conventional solid cores are typically compression molded from a slug of uncured or lightly cured elastomer composition comprising a high cis content polybutadiene and a metal salt of an α, β, ethylenically unsaturated carboxylic acid such as zinc mono or diacrylate or methacrylate. To achieve higher coefficients of restitution in the core, the manufacturer may include activators such as small amounts of a metal oxide such as zinc oxide. In addition, larger amounts of metal oxide than those that are needed to achieve the desired coefficient are often included in conventional cores in order to increase the core weight so that the finished ball more closely approaches the U.S.G.A. upper weight limit of 1.620 ounces. Other materials may be used in the core composition including compatible rubbers or ionomers, and low molecular weight fatty acids such as stearic acid. Free radical initiators such as peroxides are admixed with the core composition so that on the application of heat and pressure, a complex curing cross-linking reaction takes place.

The inner cover layer 14 surrounds the core 10. The inner cover layer 14 may be the only inner cover layer for the ball or may be one of two or more inner cover layers. The inner cover layer 14 contains a resin composition with at least 50 parts by weight, more preferably at least 75 parts by weight, and most preferably at least 90 parts by weight of a non-ionomeric polyolefin based upon 100 parts by weight of the resin composition. A non-ionomeric polyolefin according to the invention is a polyolefin which is not a copolymer of an olefin, such as ethylene or another olefin having from 2 to 8 carbon atoms, and a metal salt of an unsaturated monocarboxylic acid, such as acrylic acid, methacrylic acid or another unsaturated monocarboxylic acid having from 3 to 8 carbon atoms. The inner cover layer 14 also contains at least one part by weight of a filler based upon 100 parts by weight of the resin composition. The filler preferably is used to adjust the density, flex modulus, mold release, and/or melt flow index of the inner cover layer. More preferably, at least when the filler is for adjustment of density or flex modulus, it is present in an amount of at least five parts by weight based upon 100 parts by weight of the resin composition. With some fillers, up to about 200 parts by weight probably can be used. A density adjusting filler according to the invention preferably is a filler which has a specific gravity which is at least 0.05 and more preferably at least 0.1 higher or lower than the specific gravity of the resin composition. Particularly preferred density adjusting fillers have specific gravities which are higher than the specific gravity of the resin composition by 0.2 or more, even more preferably by 2.0 or more. A flex modulus adjusting filler according to the invention is a filler which, when used in an amount of e.g. 1–100 parts by weight based upon 100 parts by weight of resin composition, will raise or lower the flex modulus (ASTM D-790) of the resin composition by at least 1% and preferably at least 5% as compared to the flex modulus of the resin composition without the inclusion of the flex modulus adjusting filler. A mold release adjusting filler is a filler which allows for easier removal of part from mold, and eliminates or reduces the need for external release agents which otherwise could be applied to the mold. A mold release adjusting filler typically is used in an amount of up to about 2 wt % based upon the total weight of the inner cover layer. A melt flow index adjusting filler is a filler which increases or decreases the melt flow, or ease of processing of the composition.

The inner cover layer, outer cover layer and core may contain coupling agents that increase adhesion of materials within a particular layer e.g. to couple a filler to a resin composition, or between adjacent layers. Non-limiting examples of coupling agents include titanates, zirconates and silanes. Coupling agents typically are used in amounts of 0.1–2 wt % based upon the total weight of the composition in which the coupling agent is included.

It is not necessary that the inner cover layer 14 contribute to the COR of the ball. In fact, the covered core may have a COR that is somewhat lower than the COR of the central core. The degree to which the inner cover layer 14 can slightly reduce COR of the core 10 will depend upon the thickness of the outer cover layer 16 and the degree to which the outer cover layer 16 contributes to COR. To enable a broad range of outer cover layer materials to be used, it is preferred that the inner cover layer 14 result in no more than a 0.5–10% reduction in the COR for the core when covered with the inner cover layer, as compared to the COR of the core 10 alone.

A density adjusting filler is used to control the moment of inertia, and thus the initial spin rate of the ball and spin decay. The addition of a filler with a lower specific gravity than the resin composition results in a decrease in moment of inertia and a higher initial spin rate than would result if no filler were used. The addition of a filler with a higher specific gravity than the resin composition results in an increase in moment of inertia and a lower initial spin rate. High specific gravity fillers are preferred as less volume is used to achieve the desired inner cover total weight. Non-reinforcing fillers are also preferred as they have minimal effect on COR. Preferably, the filler does not chemically react with the resin composition to a substantial degree, although some reaction may occur when, for example, zinc oxide is used in a cover layer which contains some ionomer.

The density-increasing fillers for use in the invention preferably have a specific gravity in the range of 1.0–20. The density-reducing fillers for use in the invention preferably have a specific gravity of 0.06–1.4, and more preferably 0.06–0.90. The flex modulus increasing fillers have a reinforcing or stiffening effect due to their morphology, their interaction with the resin, or their inherent physical properties. The flex modulus reducing fillers have an opposite effect due to their relatively flexible properties compared to the matrix resin. The melt flow index increasing fillers have a flow enhancing effect due to their relatively high melt flow versus the matrix. The melt flow index decreasing fillers have an opposite effect due to their relatively low melt flow index versus the matrix.

Fillers which may be employed in the inner cover layer may be or are typically in a finely divided form, for example, in a size generally less than about 20 mesh, preferably less than about 100 mesh U.S. standard size, except for fibers and flock, which are generally elongated. Flock and fiber sizes should be small enough to facilitate processing. Filler particle size will depend upon desired effect, cost, ease of addition, and dusting considerations. The filler preferably is selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, tungsten carbide, metal oxides, metal stearates, particulate carbonaceous materials, micro balloons, and combinations thereof. Non-limiting examples of suitable fillers, their densities, and their preferred uses are as follows:

TABLE 1

| Filler Type | Spec. Grav. | Comments |
|---|---|---|
| Precipitated hydrated silica | 2.0 | 1,2 |
| Clay | 2.62 | 1,2 |
| Talc | 2.85 | 1,2 |
| Asbestos | 2.5 | 1,2 |
| Glass fibers | 2.55 | 1,2 |
| Aramid fibers (KEVLAR ®) | 1.44 | 1,2 |
| Mica | 2.8 | 1,2 |
| Calcium metasilicate | 2.9 | 1,2 |
| Barium sulfate | 4.6 | 1,2 |
| Zinc sulfide | 4.1 | 1,2 |
| Lithopone | 4.2–4.3 | 1,2 |
| Silicates | 2.1 | 1,2 |
| Silicon carbide platelets | 3.18 | 1,2 |
| Silicon carbide whiskers | 3.2 | 1,2 |
| Tungsten carbide | 15.6 | 1 |
| Diatomaceous earth | 2.3 | 1,2 |
| Polyvinyl chloride | 1.41 | 1,2 |
| Carbonates | | |
| Calcium carbonate | 2.71 | 1,2 |
| Magnesium carbonate | 2.20 | 1,2 |
| Metals and Alloys (powders) | | |
| Titanium | 4.51 | 1 |
| Tungsten | 19.35 | 1 |
| Aluminum | 2.70 | 1 |
| Bismuth | 9.78 | 1 |
| Nickel | 8.90 | 1 |
| Molybdenum | 10.2 | 1 |
| Iron | 7.86 | 1 |
| Steel | 7.8–7.9 | 1 |
| Lead | 11.4 | 1,2 |
| Copper | 8.94 | 1 |
| Brass | 8.2–8.4 | 1 |
| Boron | 2.34 | 1 |
| Boron carbide whiskers | 2.52 | 1,2 |
| Bronze | 8.70–8.74 | 1 |
| Cobalt | 8.92 | 1 |
| Beryllium | 1.84 | 1 |
| Zinc | 7.14 | 1 |
| Tin | 7.31 | 1 |
| Metal Oxides | | |
| Zinc oxide | 5.57 | 1,2 |
| Iron oxide | 5.1 | 1,2 |
| Aluminum oxide | 4.0 | |
| Titanium oxide | 3.9–4.1 | 1,2 |
| Magnesium oxide | 3.3–3.5 | 1,2 |
| Zirconium oxide | 5.73 | 1,2 |
| Metal Stearates | | |
| Zinc stearate | 1.09 | 3,4 |
| Calcium stearate | 1.03 | 3,4 |
| Barium stearate | 1.23 | 3,4 |
| Lithium stearate | 1.01 | 3,4 |
| Magnesium stearate | 1.03 | 3,4 |
| Particulate carbonaceous materials | | |
| Graphite | 1.5–1.8 | 1,2 |
| Carbon black | 1.8 | 1,2 |
| Natural bitumen | 1.2–1.4 | 1,2 |
| Cotton flock | 1.3–1.4 | 1,2 |
| Cellulose flock | 1.15–1.5 | 1,2 |
| Leather fiber | 1.2–1.4 | 1,2 |
| Micro balloons | | |
| Glass | 0.15–1.1 | 1,2 |
| Ceramic | 0.2–0.7 | 1,2 |
| Fly ash | 0.6–0.8 | 1,2 |
| Coupling Agents Adhesion Promoters | | |
| Titanates | 0.95–1.17 | |
| Zirconates | 0.92–1.11 | |
| Silane | 0.95–1.2 | |

COMMENTS:
1 Particularly useful for adjusting density of the inner cover layer.
2 Particularly useful for adjusting flex modulus of the inner cover layer.
3 Particularly useful for adjusting mold release of the inner cover layer.
4 Particularly useful for increasing melt flow index of the inner cover layer. All fillers except for metal stearates would be expected to reduce the melt flow index of the inner cover layer.

The amount of filler employed is primarily a function of weight requirements and distribution.

In a particularly preferred form of the invention, the inner cover layer 14 is substantially softer and more compressible than the outer cover layer 16, thereby imparting to the golf ball a favorable soft feel without substantially reducing the overall COR of the ball. The inner cover layer 14 preferably has a Shore D hardness (measured generally in accordance with ASTM D-2240, but measured on the curved surface of the inner cover layer) in the range of 1–80, more preferably 15–65 (measured generally in accordance with ASTM D-2240, but measured on the curved surface of the inner cover layer), and most preferably about 20–40 (measured generally in accordance with ASTM D-2240, but measured on the curved surface of the inner cover layer). On the other hand, hard inner cover layers 14 can be used as long as favorable playability and durability are maintained. The inner cover layer 14 has a thickness of 0.040–0.150 inches, more preferably 0.050–0.125 inches, and most preferably 0.055–0.10 inches.

The inner cover layer can be uncrosslinked, or can be crosslinked using an initiator such as a peroxide or irradiation such as electron beam treatment, gamma radiation, and the like.

In the preferred embodiment, the inner cover layer 14 is softer than the outer surface of the core 10. While the outer surface of the core can have a Shore D hardness which is similar to or less than that of the material of inner cover layer 14, it is preferred that the Shore D hardness of the inner cover layer 14 not exceed the Shore D hardness of the outer surface of the core 10 by more than about 5.

Examples of non-ionomeric polyolefin materials which are suitable for use in forming the inner cover layer 14 include, but are not limited to, low density polyethylene, linear low density polyethylene, high density polyethylene, polypropylene, rubber-toughened olefin polymers, acid copolymers which do not become part of an ionomeric copolymer when used in the inner cover layer, plastomers, flexomers, and thermoplastic elastomers such as styrene/butadiene/styrene (SBS) or styrene/ethylene-butylene/styrene (SEBS) block copolymers, including Kraton® (Shell), dynamically vulcanized elastomers such as Santoprene® (Monsanto), ethylene vinyl acetates such as Elvax® (DuPont), ethylene methyl acrylates such as Optema® (Exxon), polyvinyl chloride resins, and other elastomeric materials may be used. Mixtures, blends, or alloys involving these materials can be used. It is desirable that the polyolefin be a tough, low density material. The non-ionomeric polyolefins can be mixed with ionomers. The inner cover layer 14 optionally may include processing aids, release agents and/or diluents. In a preferred form of the invention, the inner cover layer contains a plastomer, preferably at least 50 parts by weight plastomer based upon 100 parts by weight resin composition.

Plastomers are olefin copolymers with a uniform, narrow molecular weight distribution, a high comonomer content, and an even distribution of comonomers. The molecular weight distribution of the plastomers generally is about 1.5–4, preferably 1.5–3.5 and more preferably 1.5–2.4. The density is typically in the range of 0.85–0.97 if unfoamed and 0.10–0.90 if foamed. The comonomer content typically is in the range of 1–32%, and preferably 2–20%. The composition distribution breadth index generally is greater than 30%, preferably is at least 45%, and more preferably is at least 50%.

The term "copolymer" includes (1) copolymers having two types of monomers which are polymerized together, (2) terpolymers (which are formed by the polymerization of three types of monomers), and (3) copolymers which are formed by the polymerization of more than three types of monomers. The compositions further may include additives and fillers as well as a co-agent for use with a curing agent to aid in crosslinking the plastomer or to improve processability.

The "composition distribution breadth index" (CDBI) is defined as the weight percent of the copolymer molecules which have a comonomer content within 50 percent of the median total molar comonomer content.

Plastomers are polyolefin copolymers developed using metallocene single-site catalyst technology. Plastomers exhibit both thermoplastic and elastomeric characteristics. In addition to being comprised of a polyolefin, plastomers generally contain up to about 32 wt % comonomer. Plastomers which are useful in making golf balls include but are not limited to ethylene-butene copolymers, ethylene-octene copolymers, ethylene-hexene copolymers, and ethylene-hexene-butene terpolymers, as well as mixtures thereof.

The plastomers employed in the invention preferably are formed by a single-site metallocene catalyst such as those disclosed in EP 29368, U.S. Pat. Nos. 4,752,597, 4,808,561, and 4,937,299, the teachings of which are incorporated herein by reference. As is known in the art, plastomers can be produced by metallocene catalysis using a high pressure process by polymerizing ethylene in combination with other monomers such as butene-1, hexene-1, octene-1 and 4-methyl-1-pentene in the presence of catalyst system comprising a cyclopentadienyl-transition metal compound and an alumoxane.

EXACT™ plastomers (Exxon Chemical Co., Houston, Tex.) are metallocene-catalyzed polyolefins. This family of plastomers has a density of 0.87–0.915 g/cc, melting points in the range of 140°–220° F., Shore D hardness in the range of 20–50 (measured generally in accordance with ASTM D-2240, but measured on the curved surface of the inner cover layer), flexural modulus in the range of 2–15 k.p.s.i., tensile strength of 1600–4000 p.s.i., excellent thermal stability, and very good elastic recovery. One of these materials, known as EXACT™ 4049, is a butene copolymer with a comonomer content of less than 28% and a polymer density of 0.873 g/cc. The properties of EXACT™ 4049 are shown on Table 2 below:

TABLE 2

| | Typical Values[1] | ASTM Method |
|---|---|---|
| Polymer Properties | | |
| Melt flow index | 4.5 dg/min | D-1238 (E) |
| Density | 0.873 g/cm$^3$ | D-792 |
| Elastomer Properties[2] | | |
| Hardness | 72 Shore A<br>20 Shore D | D-2240 |
| Ultimate Tensile[3], Die D | 900 p.s.i. (6.4 MPa) | D-412 |
| Tensile Modulus | | D-412 |
| @ 100% elongation | 280 p.s.i. (2 MPa) | |
| @ 300% elongation | 350 p.s.i. (2.4 MPa) | |
| Ultimate Elongation | 2000% | D-412 |
| Brittleness Temperature | ←112° F. (←80° C.) | D-746 |
| Vicat Softening Point, 200 g | 130° F. (55° C.) | D-1525 |
| Mooney Viscosity | | |
| (1 + 4 @ 125° C.) | 6.5 Torque Units | D-1646 |

[1]Values are typical and are not to be interpreted as specifications.
[2]Compression molded specimens.
[3]Tensile properties determined using a type D die & a crosshead speed of 20 in/min.

This material has been found to be particularly useful in forming the inner cover layer 14.

Other non-limiting examples of EXACT plastomers which are useful in the invention include linear ethylene-butene copolymers such as EXACT 3024 having a density of about 0.905 gms/cc (ASTM D-1505) and a melt flow index of about 4.5 g/10 min. (ASTM D-2839); EXACT 3025 having a density of about 0.910 gms/cc (ASTM D-1505) and a melt flow index of about 1.2 g/10 min. (ASTM D-2839); EXACT 3027 having a density of about 0.900 gms/cc (ASTM D-1505) and a melt flow index of about 3.5 g/10 min. (ASTM D-2839); and EXACT 4011 having a density of about 0.887 gms/cc (ASTM D-1505) and a melt flow index of about 2.2 g/10 min. (ASTM D-2839); and ethylene-hexene copolymers such as EXACT 3031 having a density of about 0.900 gms/cc (ASTM D-1505) and a melt flow index of about 3.5 g/10 min. (ASTM D-2839). Other non-limiting examples of useful EXACT plastomers are EXACT 4005 and EXACT 5010. Terpolymers of e.g. ethylene, butene and hexene also can be used. All of the above EXACT series plastomers are available from EXXON Chemical Co. Similar materials sold by Dow Chemical Co. as Insite® technology under the Affinity® and Engage® trademarks also can be used.

EXACT plastomers typically have a molecular weight distribution ($M_w/M_n$) of about 1.5 to 2.4, where $M_w$ is weight average molecular weight and $M_n$ is number average molecular weight, a molecular weight of about 5,000 to about 50,000, preferably about 20,000 to about 30,000, and a melt flow index above about 0.50 g/10 mins, preferably about 1–10 g/10 mins as determined by ASTM D-1238, condition E. Plastomers which may be employed in the invention include copolymers of ethylene and at least one $C_3$–$C_{20}$ α-olefin, preferably a $C_4$–$C_8$ α-olefin present in an amount of about 5 to about 32 mole %, preferably about 7 to about 22 mole %, more preferably about 9–18 mole %. These plastomers are believed to have a composition distribution breadth index of about 45% or more.

Plastomers such as those sold by Dow Chemical Co. under the tradename ENGAGE are believed to be produced in accordance with U.S. Pat. No. 5,272,236, the teachings of which are incorporated herein in their entirety by reference. These plastomers are substantially linear polymers having a density of about 0.85 gms/cc to about 0.97 g/cc measured in accordance with ASTM D-792, a melt flow index ("MI") of about 0.01 gms/10 minutes to about 1000 grams/10 minutes, a melt flow ratio ($I_{10}/I_2$) of about 7 to about 20, where $I_{10}$ is measured in accordance with ASTM D-1238 (190/10) and $I_2$ is measured in accordance with ASTM D-1238 (190/2.16), and a molecular weight distribution $M_w/M_n$ which preferably is less than 5, and more preferably is less than about 3.5 and most preferably is from about 1.5 to about 2.5. These plastomers include homopolymers of $C_2$–$C_{20}$ olefins such as ethylene, propylene, 4-methyl-1-pentene, and the like, or they can be interpolymers of ethylene with at least one $C_3$–$C_{20}$ α-olefin and/or $C_2$–$C_{20}$ acetylenically unsaturated monomer and/or $C_4$–$C_{18}$ diolefins. These plastomers generally have a polymer backbone that is either unsubstituted or substituted with up to 3 long chain branches/1000 carbons. As used herein, long chain branching means a chain length of at least about 6 carbons, above which the length cannot be distinguished using $^{13}C$ nuclear magnetic resonance spectroscopy. The preferred ENGAGE plastomers are characterized by a saturated ethylene-octene backbone, a narrow molecular weight distribution $M_w/M_n$ of about 2, and a narrow level of crystallinity. These plastomers also are compatible with pigments, brightening agents, fillers such as those described above, as well as with plasticizers such as paraffinic process oil and naphthenic process oil. Other commercially available plastomers may be useful in the invention, including those manufactured by Mitsui.

The molecular weight distribution, ($M_w/M_n$), of plastomers made in accordance with U.S. Pat. No. 5,272,236 most preferably is about 2.0. Non-limiting examples of these plastomers include ENGAGE CL 8001 having a density of about 0.868 gms/cc, a melt flow index of about 0.5 g/10 mins, and a Shore A hardness of about 75; ENGAGE CL 8002 having a density of about 0.87 gms/cc, a melt flow index of about 1 gms/10 min, Shore A hardness of about 75; ENGAGE CL 8003 having a density of about 0.885 gms/cc, melt flow index of about 1.0 gms/10 min, and a Shore A hardness of about 86; ENGAGE EG 8100 having a density of about 0.87 gms/cc, a melt flow index of about 1 gms/10 min., and a Shore A hardness of about 87; ENGAGE 8150 having a density of about 0.868 gms/cc, a melt flow index of about 0.5 gms/10 min, and a Shore A hardness of about 75; ENGAGE 8200 having a density of about 0.87 gms/cc, a melt flow index of about 5 g/10 min., and a Shore A hardness of about 75; and ENGAGE EP 8500 having a density of about 0.87 gms/cc, a melt flow index of about 5 g/10 min., and a Shore A hardness of about 75.

The outer cover layer 16 of the golf ball of the invention surrounds the inner cover layer 14 and is formed from a material that has properties sufficient to contribute about 0.001–0.050 points, more preferably 0.010–0.040 points, and most preferably at least 0.015 points to the COR of the ball. The outer cover layer preferably comprises an ionomer. Alternatively or additionally, other thermoplastic materials which can contribute to the COR of the ball at necessary amounts can be used. The ionomer can be of a single type or can be a blend of two or more types of ionomers. One or more hardening or softening modifiers can be blended with the ionomer.

The compression of the outer cover layer is appropriate to result in an overall PGA ball compression of about 30–110, more preferably 50–100, and most preferably 60–90.

The outer cover layer preferably has a thickness of 0.030–0.150 inches, more preferably 0.050–0.10 inches, and most preferably 0.06–0.09 inches. The combined thickness of the inner and outer cover layers typically is in the range of 0.10–0.25 inches, more preferably 0.10–0.20 inches, and most preferably 0.10–0.15 inches. The overall cover thickness preferably is at least 0.10 inches. Balls having an overall cover thickness of at least 0.13 inches, or at least 0.14 inches, are preferred when a long distance ball is desired that also has a pleasant feel. The feel, spin and distance properties can be varied depending on the choice of inner and outer cover materials. The ratio of the ball diameter to the overall cover thickness preferably is no more than about 18:1, more preferably no more than about 17:1, and most preferably no more than about 15:1. In a preferred form of the invention, the multi-layer golf ball has playability properties comparable to those of a ball with a single-layer ionomeric cover, but the multi-layer ball contains only 5–90 wt % as much ionomer, and more preferably only 40–60 wt % as much ionomer as a ball with a single cover layer.

The outer cover layer can be coated with a top coat of a conventional type and thickness. Optionally, a conventional primer coat can be used between the outer cover layer and the top coat.

The golf ball of the invention generally has a diameter of at least 1.68 inches, and preferably is an oversized ball with a diameter of at least 1.70 inches, or more preferably at least 1.72 inches. In addition to allowing the use of larger diameter dimples, the larger diameter ball provides a moment which is greater than the conventional ball. This greater moment reveals itself by having a lower backspin rate after impact than the conventional ball. Such a lower backspin rate contributes to straighter shots, greater efficiency in flight, and a lesser degree of energy loss on impact with the ground. On impact with the ground, all balls reverse their spin from backspin to over-spin. With lower backspin on impact, less energy is absorbed in this reversal than with conventional balls. This is especially true with woods because of the lower trajectory resulting from a lower backspin. As a result, the ball strikes the ground at a more acute angle, adding increased roll and distance.

The golf ball of the invention preferably, but not necessarily, has a spin in the range of 9,000 revolutions per minute (rpm) or less, and more preferably 8,000 rpm or less when measured using a 9 iron at a clubhead speed of about 105 feet per second under conditions of launch angle, ball speed and tee position which produce a spin rate of about 7100 rpm for a two-piece hard covered ball (1994 Top-Flite XL) and a spin rate of about 9700 rpm for a thread wound balata covered ball (1994 Titleist Tour 100) using the same club. To provide for appropriate values of durability and spin, the Shore D hardness of the outer cover layer should be at least about 60 (measured generally in accordance with ASTM D-2240, but measured on a land area of the curved surface of the outer cover layer). The PGA compression of the ball preferably is no more than about 90, and more preferably no more than about 80.

When the golf ball of the invention has more than two cover layers, the inner cover layer can be formed from two or more layers which, taken together, meet the requirements of softness, thickness and compression of the layer or layers which are defined herein as the inner cover layer. Similarly, the outer cover layer can be formed from two or more layers which, taken together, meet the requirements of hardness, thickness and compression of the layer or layers which are defined herein as the outer cover layer. Furthermore, one or more additional, very thin ionomeric or non-ionomeric layers can be added on either side of the inner cover layer as long as the objectives of the invention are achieved.

Comparative Example 1

Two-Layer Ball

About 12 golf ball cores having a diameter of 1.545 inches, a PGA compression of 64 and a COR of 0.765 were obtained. The cores contained a blend of polybutadiene, zinc diacrylate, zinc oxide, and conventional additives.

A single cover layer having a thickness of 0.090 inches was injection molded over the cores. The cover material contained a blend of ionomers designated as ionomer 1 and had a Shore D hardness of 68 (measured generally in accordance with ASTM D-2240, but measured on a land area of the curved surface of the cover layer). The covered balls were primed and top coated using conventional materials.

Properties of the balls are shown on Table 3.

The balls had a PGA compression of 88.5, a COR of 0.807 and a spin rate of about 7368 revolutions per minute (rpm) when struck with a 9-iron at a clubhead speed of about 105 feet per second under conditions of launch angle, ball speed and tee position which produced a spin rate of about 7100 rpm for a two-piece hard covered ball (1994 Top-Flite XL) and a spin rate of about 9700 rpm for a thread wound balata covered ball (1994 Titleist Tour 100) using the same club.

An outer cover layer formed from the same blend of ionomers as was used for the covers of the balls of Comparative Example 1 was injection molded over the inner cover layers in a thickness of 0.090 inches. The outer cover layer had a Shore D hardness of 68 (measured generally in accordance with ASTM D-2240, but measured on a land area of the curved surface of the outer cover layer).

The resulting golf balls were primed and top coated using the same materials and thickness as were used in Comparative Example 1. The resulting balls had a coefficient of restitution of 0.796, and a PGA compression 79. The properties of the cores, cover layers and overall golf balls are shown on Table 3.

EXAMPLES 2–5

Multi-Layer Balls With Non-Ionomeric Polyolefin Inner Cover Layer

The procedure of Example 1 was repeated using different combinations of inner cover layer thickness and core size and composition. The same types of inner and outer cover layer materials were used in Examples 2–5 as were used in Example 1. The results are shown on Table 3.

As shown by Examples 1–5, golf balls having a good coefficient of restitution and soft compression can be obtained even when the inner cover layer is not an ionomer or balata. Surprisingly, the relative thicknesses of the inner cover layer and outer cover layer had little impact on COR. The balls of Example 5 exhibited a high COR while having a thick inner cover layer and a soft compression. The balls of Example 3 have a relatively high COR in combination with a soft inner cover layer and a low spin rate.

TABLE 3

| | Core | | | | Inner Cover Layer | | | | | Outer Cover Layer | Ball | | | |
|---|---|---|---|---|---|---|---|---|---|---|---|---|---|---|
| Example # | Material | Size (inches) | COMP (PGA) | COR (×1000) | Material | Thickness (inches) | COMP (PGA) | COR (×1000) | Hardness (Shore D) | Thickness (inches) | COMP (PGS) | COR (×1000) | Weight (g) | Spin (RPM) |
| Comp. 1 | PBD BL1[1] | 1.545 | 64 | 765 | None | N/A | N/A | N/A | N/A | 0.090 | 89 | 807 | 45.3 | 7368 |
| 1 | PBD BL1 | 1.43 | —[2] | 763 | Polyolefin | 0.058 | 58 | 763 | 30 | 0.090 | 79 | 796 | 45.9 | — |
| 2 | PBD BL1 | 1.43 | — | 763 | Polyolefin | 0.070 | 55 | 761 | 30 | 0.075 | 78 | 794 | 43.8 | 7945 |
| 3 | PBD BL2[3] | 1.47 | 90 | 789 | Polyolefin | 0.050 | 82 | 787 | 30 | 0.0765 | 93 | 806 | 44.9 | 7736 |
| 4 | PBD BL2 | 1.43 | — | 788 | Polyolefin | 0.058 | 75 | 785 | 30 | 0.090 | 89 | 807 | 44 | 8039 |
| 5 | PBD BL2 | 1.43 | — | 788 | Polyolefin | 0.070 | 70 | 784 | 30 | 0.075 | 83 | 803 | 45.8 | — |

[1]Polybutadiene blend 1
[2]"—" indicates that no measurement was made due to small core size
[3]Polybutadiene blend 2

EXAMPLE 1

Multi-Layer Ball With Non-Ionomeric Polyolefin Inner Cover Layer

About 12 golf ball cores made of the same material as those of Comparative Example 1 and having a diameter of 1.43 inches were obtained. The cores had a COR of 0.763. The cores were coated with a polyolefin material in a thickness of 0.058 inches. The polyolefin material was a butene comonomer with a melt flow index of 4.5 dg/min and is available under the unregistered trademark EXACT™ 4049 (Exxon Chemical Company, Houston, Tex.).

Comparative Example 2

Multi-Layer Golf Ball With Unfilled Ionomeric Inner Cover Layer

A number of golf balls were formed which had compression molded cores with a diameter of 1.47 inches, a weight of 32.7 g, a PGA compression of 60 and a COR of 0.763. The cores were covered with an injection molded inner cover layer of 50 wt % EX 1002 and 50 wt % EX 1003 (Exxon Chemical Co., Houston, Tex.). The physical properties of EX 1002 and EX 1003 are shown below.

| Resin/Property | ASTM Method | EX 1002 | EX 1003 |
|---|---|---|---|
| Cation | | Na | Zn |
| Melt flow index (g/10 min) | D-1235 | 1.6 | 1/1 |
| Melting Point (C.) | D-3417 | 83.7 | 82 |
| Crystallization Point (C.) | D-3417 | 43.2 | 51.5 |
| Plaque Properties (2 mm thick compression molding) | | | |
| Tensile Strength at Break MPa | D-638 | 31.7 | 24.8 |
| Yield Point MPa | D-638 | 22.5 | 14.9 |
| Elongation at Break % | D-638 | 348 | 387 |
| 1% Secant Modulus MPa | D-638 | 418 | 145 |
| 1% Flexural Modulus MPa | D-790 | 380 | 147 |
| Shore D Hardness | D-2240 | 62 | 54 |
| Vicat Softening Point | D-1525 | 51.5 | 56 |

An outer cover layer having cover formulation A, shown below, was injection molded over the inner cover layer.

| Outer Cover Layer Formulation A | |
|---|---|
| Iotek[1] 7510 | 42 wt % |
| Iotek 7520 | 42 wt % |
| Iotek 8000 | 8.7 wt % |
| Iotek 7030 | 7.3 wt % |
| Whitener package | 2.371 parts per 100 parts of resin (phr) |
| Whitener package: | |
| Titanium dioxide[2] | 2.3 phr |
| Optical brightener[3] | 0.025 phr |
| Pigment[4] | 0.042 phr |
| Stabilizer[5] | 0.004 phr |

[1]Exxon Chem. Co., (Houston, TX)
[2]Unitane 0-110, Kemira, Inc., GA
[3]Eastobrite OB-1, Eastman Chemical Company
[4]Ultramarine Blue, Whitaker, Clark and Daniels, South Plainfield, NJ
[5]Santonox R, Monsanto Chemical Co., St. Louis, MO The golf balls were then primed with a waterborne polyurethane dispersion-type primer and top coated with a two component solvent borne polyurethane coating formed from polyester polyols and aliphatic isocyanates. Properties of the covered cores and finished balls are shown below on Table 4.

EXAMPLES 6–20

Multi-Layer Golf Balls With Inner Cover Layer Containing Ionomer and Filler

The procedure of Comparative Example 2 was repeated with the exception that the inner cover layer contained 47.5 wt % EX 1002, 47.5 wt % EX 1003 and 5 wt % filler. A different filler was used in each of Examples 6–20. The fillers and resulting properties of the golf balls are provided below on Table 4.

As shown below on Table 4, different fillers resulted in golf balls with different weights and PGA compressions. The inclusion of filler had very little impact on COR.

It is believed that if the resin composition of the inner cover layer were replaced by a resin composition containing at least 50 parts by weight of a non-ionomeric polyolefin based upon 100 parts by wight of resin composition, and a number of control golf balls were made having the same core, inner cover layer and outer cover layer compositions as the non-ionomeric polyolefin-containing golf balls with the exception that the inner cover layers were unfilled, the differences between the properties of the balls with filled and unfilled inner cover layers would be generally comparable to the differences between balls having unfilled (Comparative Example 2) and filled (Examples 6–20) inner cover layers of ionomer.

Comparative Example 3

Multi-Layer Golf Ball With Unfilled Ionomeric Inner Cover Layer

The procedure of Comparative Example 2 was repeated with the exception that the cores which were used had a PGA compression of 61 and a COR of 0.761. The size of the cores was 1.47 inches and the weight of the cores was 32.7 g. The properties of the balls are shown on Table 4.

EXAMPLES 21–22

Multi-Layer Golf Balls With Inner Cover Layer Containing Ionomer and Filler

The procedure of Examples 6–20 was repeated with the exception that the cores which were used were the same as those of Comparative Example 3. The ball properties are shown on Table 4. The fillers resulted in an increase in PGA compression and increase in ball weight and a decrease in COR.

TABLE 4

| | | Core and Inner Cover Layer | | | | Unfinished Ball | | | | Finished Ball | | | |
|---|---|---|---|---|---|---|---|---|---|---|---|---|---|
| Example # | Additive | Size (in.) | Weight (g) | Comp. (PGA) | C.O.R. | Size (in.) | Weight (g) | Comp. (PGA) | C.O.R. | Size (in.) | Weight (g) | Comp. (PGA) | C.O.R. |
| Comp. 2 | — | 1.574 | 38.5 | 74 | 0.7925 | 1.686 | 45.63 | 80 | 0.7771 | 1.686 | 45.66 | 82 | 0.7744 |
| 6 | 5% Bismuth Powder[1] | 1.573 | 38.8 | 76 | 0.7921 | 1.686 | 45.89 | 81 | 0.7765 | 1.685 | 45.92 | 82 | 0.7746 |
| 7 | 5% Boron Powder[1] | 1.574 | 38.8 | 77 | 0.7543 | 1.686 | 45.79 | 81 | 0.7754 | 1.686 | 45.82 | 83 | 0.7725 |
| 8 | 5% Brass Powder[1] | 1.575 | 38.9 | 76 | 0.7944 | 1.686 | 45.9 | 80 | 0.7757 | 1.686 | 45.96 | 82 | 0.7733 |
| 9 | 5% Bronze Powder[1] | 1.573 | 38.8 | 76 | 0.7936 | 1.686 | 45.89 | 80 | 0.777 | 1.686 | 45.92 | 82 | 0.7729 |
| 10 | 5% Cobalt Powder[1] | 1.573 | 38.9 | 78 | 0.7948 | 1.686 | 46.88 | 81 | 0.7775 | 1.686 | 45.91 | 83 | 0.7749 |
| 11 | 5% Copper Powder[1] | 1.574 | 38.9 | 76 | 0.7932 | 1.686 | 46.9 | 80 | 0.7762 | 1.686 | 45.99 | 82 | 0.7740 |
| 12 | 5% Inconnel Metal Powder[1] | 1.674 | 39.0 | 77 | 0.7926 | 1.687 | 45.94 | 80 | 0.7757 | 1.686 | 46.05 | 83 | 0.7738 |
| 13 | 5% Iron Metal Powder[1] | 1.575 | 38.9 | 77 | 0.7928 | 1.666 | 45.98 | 81 | 0.7759 | 1.686 | 46.08 | 84 | 0.7737 |
| 14 | 5% Molybdenum Powder[1] | 1.575 | 38.9 | 76 | 0.7919 | 1.686 | 45.96 | 80 | 0.7765 | 1.686 | 45.98 | 83 | 0.7741 |
| 15 | 5% Nickel Powder[1] | 1.574 | 38.9 | 75 | 0.7917 | 1.686 | 45.96 | 81 | 0.7753 | 1.686 | 46.03 | 83 | 0.7741 |
| 16 | 5% Stainless Steel Powder[1] | 1.674 | 38.9 | 74 | 0.7924 | 1.687 | 45.92 | 82 | 0.7757 | 1.686 | 45.99 | 82 | 0.7739 |
| 17 | 5% Titanium Metal Powder[1] | 1.574 | 39.0 | 76 | 0.7906 | 1.687 | 45.92 | 81 | 0.7746 | 1.686 | 46.02 | 84 | 0.7729 |
| 18 | 5% Zirconium Oxide Powder[1] | 1.575 | 38.9 | 75 | 0.792 | 1.686 | 45.92 | 80 | 0.7761 | 1.686 | 45.96 | 84 | 0.7736 |

TABLE 4-continued

| Example # | Additive | Core and Inner Cover Layer Size (in.) | Weight (g) | Comp. (PGA) | C.O.R. | Unfinished Ball Size (in.) | Weight (g) | Comp. (PGA) | C.O.R. | Finished Ball Size (in.) | Weight (g) | Comp. (PGA) | C.O.R. |
|---|---|---|---|---|---|---|---|---|---|---|---|---|---|
| 19 | 5% Aluminum Flakes[2] | 1.575 | 39.0 | 76 | 0.783 | 1.687 | 45.91 | 83 | 0.7685 | 1.686 | 45.95 | 86 | 0.7667 |
| 20 | 5% Aluminum Tadpoles[2] | 1.576 | 39.0 | 77 | 0.7876 | 1.687 | 45.96 | 82 | 0.7717 | 1.686 | 46.04 | 86 | 0.7705 |
| Comp. 3 | — | 1.576 | 38.7 | 78 | 0.788 | 1.687 | 45.74 | 81 | 0.7737 | 1.686 | 45.76 | 85 | 0.7729 |
| 21 | 5% Aluminum Flakes 4 × 15[1] | 1.576 | 38.9 | 80 | 0.7829 | 1.686 | 45.92 | 83 | 0.7676 | 1.686 | 45.98 | 86 | 0.7658 |
| 22 | 5% Carbon Fibers (Graphite)[4] | 1.576 | 38.9 | 81 | 0.7784 | 1.687 | 45.88 | 86 | 0.7633 | 1.686 | 45.89 | 88 | 0.7611 |

[1]Atlantic Equipment Engineers, Bergenfield, NJ
[2]Transmet Corp., Columbus, OH
[3]Glitterex Corp., Cranford, NJ
[4]R.K. Carbon Fibers, Philadelphia, PA

We claim:

1. A golf ball, comprising a core, an inner cover layer comprising a first resin composition containing at least 50 parts by weight of a non-ionomeric polyolefin material, and at least one part by weight of a filler, the parts by weight of non-ionomeric polyolefin material and filler being based upon 100 parts by weight of the first resin composition, and an outer cover layer comprising a second resin composition which is different from the first resin composition, the golf ball having an overall cover thickness of at least 0.10 inches.

2. A golf ball according to claim 1, wherein the inner cover layer has a Shore D hardness of less than 65.

3. A golf ball according to claim 1, wherein the outer cover layer is harder than the inner cover layer and has a Shore D hardness of at least 60.

4. A golf ball according to claim 1, wherein the overall cover thickness is at least 0.13 inches.

5. A golf ball according to claim 1, wherein the overall cover thickness is at least 0.14 inches.

6. A golf ball according to claim 1, wherein the second resin composition comprises an ionomer.

7. A golf ball according to claim 1, wherein the inner cover layer contains at least five parts by weight of filler.

8. A golf ball according to claim 1, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylenebutylene/styrene block copolymers, dynamically vulcanized elastomers, ethylene vinyl acetates, ethylene methyl acrylates and polyvinyl chloride resins.

9. A golf ball according to claim 1, wherein the non-ionomeric polyolefin material of the inner cover layer comprises a metallocene-catalyzed polyolefin.

10. A golf ball according to claim 1, wherein the filler is selected from the group consisting of precipitated hydrated silica, clay, talc, asbestos, glass, aramid fibers, mica, calcium metasilicate, barium sulfate, zinc sulfide, lithopone, silicon carbide, silicates, diatomaceous earth, carbonates, metals, metal alloys, metal oxides, metal stearates, particulate carbonaceous materials, cotton flock, cellulose flock, leather fiber, micro balloons and combinations thereof.

11. A golf ball according to claim 10, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylenebutylene/styrene block copolymers, dynamically vulcanized elastomers, ethylene vinyl acetates, ethylene methyl acrylates and polyvinyl chloride resins.

12. A golf ball according to claim 1, wherein the filler includes at least one member selected from the group consisting of metals and metal alloys.

13. A golf ball according to claim 1, wherein the filler is a density-adjusting filler which has a specific gravity at least 0.05 higher or lower than the specific gravity of the first resin composition.

14. A golf ball according to claim 1, wherein the core is selected from the group consisting of non-wound cores containing liquid, gel or solid, and wound cores.

15. A golf ball according to claim 1, wherein the inner cover layer is crosslinked.

16. A golf ball comprising a core, an inner cover layer comprising a first resin composition which contains at least 50 parts by weight of a non-ionomeric polyolefin material, and one or more parts by weight of at least one of a density-adjusting filler and a flex modulus adjusting filler, the parts by weight of non-ionomeric polyolefin and filler being based upon 100 parts by weight of the first resin composition, and an outer cover layer comprising a second resin composition which is different from the first resin composition.

17. A golf ball according to claim 16, wherein the filler is selected from the group consisting of precipitated hydrated silica, clay, talc, asbestos, glass, aramid fibers, mica, calcium metasilicate, barium sulfate, zinc sulfide, lithopone, silicates, silicon carbide, diatomaceous earth, carbonates, metals, metal alloys, metal oxides, metal stearates, particulate carbonaceous materials, cotton flock, cellulose flock, leather fiber, micro balloons and combinations thereof.

18. A golf ball according to claim 17, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylenebutylene/styrene block copolymers, dynamically vulcanized elastomers, ethylene vinyl acetates, ethylene methyl acrylates and polyvinyl chloride resins.

19. A golf ball according to claim 16, wherein the filler includes at least one member selected from the group consisting of metals and metal alloys.

20. A golf ball according to claim 16, wherein the filler is a density-adjusting filler which has a specific gravity at least 0.05 higher or lower than the specific gravity of the first resin composition.

21. A golf ball according to claim 16, wherein the non-ionomeric polyolefin material includes at least one member selected from the group consisting of low density polyethylene, linear low density polyethylene, high density polyethylene, polypropylene, rubber-toughened olefin polymers, acid copolymers which do not become part of an ionomeric copolymer, plastomers, flexomers, styrene/butadiene/styrene block copolymers, styrene/ethylenebutylene/styrene block copolymers, dynamically vulcanized elastomers, ethylene vinyl acetates, ethylene methyl acrylates and polyvinyl chloride resins.

22. A golf ball according to claim 16, wherein the non-ionomeric polyolefin material is a metallocene-catalyzed polyolefin.

23. A golf ball according to claim 16, wherein the inner cover layer has a Shore D hardness of 15–65.

24. A golf ball according to claim 16, wherein the inner cover layer has a thickness of at least 0.040 inches.

25. A golf ball according to claim 16, wherein the outer cover layer comprises an ionomer.

26. A golf ball comprising:

a core, an inner cover layer comprising a first resin composition containing at least 50 parts by weight of non-ionomeric polyolefin material, and one or more parts by weight of a filler with a specific gravity which is at least 0.05 higher or lower than the specific gravity of the first resin composition, the parts by weight of non-ionomeric polyolefin material and filler being based upon 100 parts by weight of the first resin composition, and an outer cover layer comprising a thermoplastic material.

27. A golf ball according to claim 26, wherein the filler is selected from the group consisting of precipitated hydrated silica, clay, talc, asbestos, glass, aramid fibers, mica, calcium metasilicate, barium sulfate, zinc sulfide, lithopone, silicates, silicon carbide, diatomaceous earth, carbonates, metals, metal alloys, metal oxides, metal stearates, particulate carbonaceous materials, cotton flock, cellulose flock, leather fiber, micro balloons and combinations thereof.

28. A method of making of a golf ball having a core and an outer cover layer comprising a second resin composition, the method comprising positioning between the core and the outer cover layer an inner cover layer comprising a first resin composition which is different from the second resin composition and which contains at least 50 parts by weight of a non-ionomeric polyolefin material, the inner cover layer further including one or more parts by weight of at least one of a density-adjusting filler and a flex modulus adjusting filler, the parts by weight of non-ionomeric polyolefin material and filler being based upon 100 parts by weight of the first resin composition.

29. A method according to claim 28, wherein the filler is selected from the group consisting of precipitated hydrated silica, clay, talc, asbestos, glass, aramid fibers, mica, calcium metasilicate, barium sulfate, zinc sulfide, lithopone, silicates, silicon carbide, diatomaceous earth, carbonates, metals, metal alloys, metal oxides including zinc oxide, iron oxide, aluminum oxide, titanium oxide, metal stearates, particulate carbonaceous materials, cotton flock, cellulose flock, leather fiber, micro balloons and combinations thereof.

30. A method according to claim 28, wherein the filler is a density-adjusting filler which has a specific gravity at least 0.05 higher or lower than the specific gravity of the first resin composition.

31. A method of making a golf ball having a core, an outer cover layer comprising a second resin composition, the method comprising positioning an inner cover layer between the core and the outer cover layer, the inner cover layer being formed from a first resin composition which is different from the second resin composition and which includes at least 50 parts by weight of a non-ionomeric polyolefin material, the inner cover layer further including one or more parts by weight of a filler, the parts by weight of non-ionomeric polyolefin and filler being based upon 100 parts by weight of the first resin composition, the overall cover thickness of the golf ball being at least 0.10 inches.

32. A method according to claim 31, wherein the inner cover layer contains at least 75 wt % metallocene catalyzed polyolefin.

33. A method according to claim 31, wherein the inner cover layer is at least 0.04 inches thick.

34. A method according to claim 31, wherein the inner cover layer is softer than the outer cover layer.

35. A method according to claim 31, wherein the filler is selected from the group consisting of precipitated hydrated silica, clay, talc, asbestos, glass, aramid fibers, mica, calcium metasilicate, barium sulfate, zinc sulfide, lithopone, silicates, silicon carbide, diatomaceous earth, carbonates, metals, metal alloys, metal oxides, metal stearates, particulate carbonaceous materials, cotton flock, cellulose flock, leather fiber, micro balloons and combinations thereof.

* * * * *